US010526733B2

(12) United States Patent
Rapp et al.

(10) Patent No.: US 10,526,733 B2
(45) Date of Patent: Jan. 7, 2020

(54) BRAIDING MACHINE

(71) Applicant: Bayerische Motoren Werke Aktiengesellschaft, Munich (DE)

(72) Inventors: Florian Rapp, Munich (DE); Fabian Rittershofer, Erdmannhausen (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 192 days.

(21) Appl. No.: 15/716,775

(22) Filed: Sep. 27, 2017

(65) Prior Publication Data

US 2018/0016718 A1 Jan. 18, 2018

Related U.S. Application Data

(63) Continuation of application No. PCT/EP2016/055549, filed on Mar. 15, 2016.

(30) Foreign Application Priority Data

Jun. 10, 2015 (DE) ..... 10 2015 210 581

(51) Int. Cl.
*D04C 3/48* (2006.01)

(52) U.S. Cl.
CPC ..... *D04C 3/48* (2013.01)

(58) Field of Classification Search
CPC ... D04C 3/00; D04C 3/02; D04C 3/04; D04C 3/06; D04C 3/08; D04C 3/10; D04C 3/12; D04C 3/14; D04C 3/16; D04C 3/18; D04C 3/20; D04C 3/22; D04C 3/24; D04C 3/26; D04C 3/28; D04C 3/30; D04C 3/32; D04C 3/34; D04C 3/36; D04C 3/38; D04C 3/40;
(Continued)

(56) References Cited

U.S. PATENT DOCUMENTS 33,569 A * 10/1861 Cady ..... D04C 3/34 87/36
429,136 A * 6/1890 Lombard ..... D04C 3/00 87/46

(Continued)

FOREIGN PATENT DOCUMENTS

CN 203333967 U 12/2013
CN 104562426 A 4/2015

(Continued)

OTHER PUBLICATIONS

Japanese-language Office Action issued in counterpart Japanese Application No. 2017-552459 dated Oct. 17, 2018 with partial English translation (nine (9) pages).

(Continued)

*Primary Examiner* — Shaun R Hurley
*Assistant Examiner* — Bao-Thieu L Nguyen
(74) *Attorney, Agent, or Firm* — Crowell & Moring LLP

(57) ABSTRACT

To ensure during the braiding of braiding cores, which have a complex braiding core geometry, for example a rectangular braiding core cross-section or one-sided cross-sectional changes, that the braiding threads are always correctly following the braiding core contour in terms of storage, a braiding ring is provided. The braiding ring is composed of a number of adjustable segments, each of which can be actuated individually and independently of the other segments by an actuator.

17 Claims, 3 Drawing Sheets

(58) Field of Classification Search
CPC ... D04C 3/42; D04C 3/44; D04C 3/43; D04C 3/48; D04C 5/26
See application file for complete search history.

(56) References Cited

U.S. PATENT DOCUMENTS

| | | | | | |
|---|---|---|---|---|---|
| 1,516,568 | A * | 11/1924 | Horn | D04C 3/00 | 87/48 |
| 5,067,384 | A * | 11/1991 | Scala | D04C 3/10 | 87/11 |
| 5,320,696 | A * | 6/1994 | McConnell | B29C 53/68 | 156/148 |
| 5,712,010 | A | 1/1998 | Russek et al. | | |
| 5,732,541 | A | 3/1998 | Kunzelman | | |
| 5,913,959 | A * | 6/1999 | Klein | D04C 3/40 | 87/33 |
| 5,918,447 | A * | 7/1999 | Hanten | A22C 11/105 | 53/551 |
| 6,202,817 | B1 * | 3/2001 | Link | F16D 13/757 | 192/111.3 |
| 6,679,152 | B1 * | 1/2004 | Head | D04C 3/34 | 87/11 |
| 6,892,510 | B2 * | 5/2005 | Sterner | B65B 51/00 | 53/138.3 |
| 7,240,466 | B2 * | 7/2007 | Vermee | A22C 11/105 | 29/243.56 |
| 8,955,819 | B2 * | 2/2015 | Landry | B65D 90/205 | 251/212 |
| 10,060,057 | B2 * | 8/2018 | Lee | D04C 3/18 | |
| 2002/0069750 | A1 * | 6/2002 | Uchida | D04C 1/06 | 87/33 |
| 2003/0040771 | A1 * | 2/2003 | Hyodoh | A61F 2/90 | 606/200 |
| 2004/0237760 | A1 * | 12/2004 | Shimizu | D04C 1/02 | 87/34 |
| 2004/0247866 | A1 * | 12/2004 | Jensen | B29C 53/564 | 428/364 |
| 2010/0052203 | A1 * | 3/2010 | Inazawa | B29C 45/14631 | 264/103 |
| 2010/0083815 | A1 * | 4/2010 | Inazawa | B29C 53/588 | 87/1 |
| 2010/0170990 | A1 * | 7/2010 | Wybrow | B29C 70/222 | 244/123.8 |
| 2011/0277618 | A1 * | 11/2011 | Giszter | D04C 3/42 | 87/8 |
| 2013/0092012 | A1 * | 4/2013 | Marchand | D04C 3/42 | 87/8 |
| 2013/0092013 | A1 * | 4/2013 | Thompson | D04C 3/40 | 87/9 |
| 2013/0305911 | A1 * | 11/2013 | Masson | D04C 1/06 | 87/9 |
| 2014/0044965 | A1 * | 2/2014 | Linow | D04O 3/48 | 428/392 |
| 2014/0182447 | A1 | 7/2014 | Kang et al. | | |
| 2015/0375447 | A1 * | 12/2015 | Tahara | B29C 70/32 | 156/443 |
| 2016/0058971 | A1 * | 3/2016 | Leeflang | A61M 25/005 | 604/524 |
| 2016/0158490 | A1 * | 6/2016 | Leeflang | A61M 25/0012 | 604/527 |
| 2016/0345676 | A1 * | 12/2016 | Bruce | A43B 23/0245 | |
| 2016/0355956 | A1 * | 12/2016 | Baumgart | D04C 3/12 | |
| 2017/0037548 | A1 * | 2/2017 | Lee | D04C 1/06 | |
| 2017/0233908 | A1 * | 8/2017 | Kroczynski | F16C 7/06 | 87/48 |
| 2018/0016718 | A1 * | 1/2018 | Rapp | D04C 3/48 | |
| 2018/0023229 | A1 * | 1/2018 | Rapp | D04C 3/48 | 87/9 |
| 2018/0105963 | A1 * | 4/2018 | Quick | D04C 3/40 | |
| 2018/0274170 | A1 * | 9/2018 | Falkenberg | H05K 9/0098 | |

FOREIGN PATENT DOCUMENTS

| | | | |
|---|---|---|---|
| DE | 10 2010 047 193 | A1 | 4/2012 |
| DE | 10 2011 006 647 | A1 | 10/2012 |
| JP | 2004-353134 | A | 12/2004 |

OTHER PUBLICATIONS

Chinese-language Office Action issued in counterpart Chinese Application No. 201680013832.4 dated Aug. 27, 2018 with English translation (nine (9) pages).
International Search Report (PCT/ISA/210) issued in PCT Application No. PCT/EP2016/055549 dated May 19, 2016 with English translation (Four (4) pages).
German-language Written Opinion (PCT/ISA/237) issued in PCT Application No. PCT/EP2016/055549 dated May 19, 2016 (Five (4) pages).
German-language Search Report issued in counterpart German Application No. 10 2015 210 581.4 dated Mar. 17, 2016 with partial English translation (Twelve (12) pages).

* cited by examiner

BRAIDING MACHINE

CROSS REFERENCE TO RELATED APPLICATIONS

This application is a continuation of PCT International Application No. PCT/EP2016/055549, filed Mar. 15, 2016, which claims priority under 35 U.S.C. § 119 from German Patent Application No. 10 2015 210 581.4, filed Jun. 10, 2015, the entire disclosures of which are herein expressly incorporated by reference.

BACKGROUND AND SUMMARY OF THE INVENTION

The invention relates to a braiding machine, in particular a circular braiding machine, for braiding a braiding core that is fed in a permanently continuous or pendulous manner, having at least two braiding thread spools and having a braiding ring that is disposed between the braiding thread spools and the run-on point of the braiding threads onto the braiding core. The braiding threads are guided over the internal surface of the braiding ring, and the latter is composed of a plurality of adjustable segments, wherein each adjustable segment of the braiding ring has a dedicated adjustment installation.

In braiding machines, in particular in circular braiding machines, braiding cores which have a cross section that is consistent or changes substantially in the longitudinal direction of the braiding core are often fed in order for the component to be produced to be imparted the later shape thereof.

The braiding cores herein can remain in the later component or be released therefrom as a lost core.

Individual threads or else braiding fibers, for example rovings from carbon or glass fibers, can be used as braiding threads.

So-called preforms which serve for the downstream production of diverse components from fiber-reinforced plastics can be made from these braiding threads or braiding fibers by braiding the latter about a braiding core. It is mandatory herein, with a view to high quality of the later components, that the braiding threads or braiding fibers are deposited onto the braiding core as precisely as possible.

In the case of the conventional braiding procedure, the braiding thread spools are received by bobbins which are moved relative to one another on guide tracks such that a braided product is created. The bobbins herein have dissimilar directions of revolving about the braiding core.

In the case of circular braiding machines, the guide tracks are two concentric circular paths that move in opposite directions, the braiding core to be braided moving in the center of said paths so as to be axially offset. It is thus achieved that the braiding threads or braiding fibers of the bobbins in the positive direction of rotation continuously cross those of the negative direction of rotation such that a circular braided product is configured as a braided core is braided.

If braided cores having a complex core geometry are used in the braiding machines, a uniform braided structure cannot be achieved by way of the usually round braiding rings with a constant opening cross section.

Differences, which in some instances are significant in terms of the local braiding angle, the layer thickness, and the thread density on the individual sides of the braiding core, are created when rigid braiding rings having a round opening cross section are used, even in the case of braiding core cross sections having very dissimilar lateral lengths.

Furthermore, in the case of curved braiding cores, dissimilar braided structures are created on the internal and the external radius of the curvature when the known rigid braiding rings having a round opening cross section are used.

In order to redress this, DE 10 2010 047 193 A1 describes a circular braiding machine which has a braiding ring made from four angled segments which can all be simultaneously displaced radially toward the braiding core or away from the latter by the same displacement path. The individual segments mutually overlap on the free ends thereof. The adjustment installations engage in the angled region thereof.

This arrangement has the disadvantage that the individual segments of the braiding ring can follow changes in the cross section of the braiding core only when said changes run symmetrically to the longitudinal axis of the braiding ring. Local convexities or concavities, respectively, of the braiding core cannot be followed, such that the quality of the braided product is compromised. Likewise, braiding cores having very dissimilar lateral lengths cannot be braided with adequate quality.

Another solution is known from U.S. Pat. No. 6,679,152 B 1. Here, at least one adjustable braiding ring in the manner of an iris aperture is provided in the case of a circular braiding machine. Here too, all segments can only be adjusted simultaneously by the same angular increment. Therefore, it is also not possible for the unilaterally changing cross-sectional shape of a braiding core to be followed with this braiding ring.

It is an object of the present invention to provide a braiding ring that is composed of individual segments such that even complex braiding core geometries can be braided with high quality, using said braiding ring.

This object is achieved by a braiding machine, in particular a circular braiding machine, for braiding a braiding core that is fed in a permanently continuous manner, having a cross section that varies in the longitudinal direction of the braiding core, having at least two braiding thread spools and having a braiding ring that is disposed between the braiding thread spools and the run-on point of the braiding threads onto the braiding core. The braiding threads are guided over the internal surface of said braiding ring, and the latter is composed of a plurality of adjustable segments, wherein each adjustable segment of the braiding ring has a dedicated adjustment installation. Each adjustment installation is actuatable independently of the adjustment installations of the other segments.

On account of each segment of the braiding ring being able to be adjusted individually by an arbitrary increment, the braiding rings can be adapted in an optimal manner even in the case of complex braiding core geometries such as rectangular braiding cores having a maximum ratio of W/H=3/1, oval braiding core cross sections, or abrupt and/or unilateral changes in the cross section of the braiding core cross section etc., and the braiding threads or braiding fibers, respectively, can thus be guided in an optimal manner. On account thereof, it is possible for the positionally correct run-on point of the braiding threads onto the respective braiding core area to always be guaranteed. Above all, the clear spacing between the internal surface of the braiding ring and the run-on point can also be minimized at all times. The braided structure across the length of a braiding core having a complex geometry thus becomes substantially more consistent, or can be influenced in a targeted localized manner such that the adaptation of the braiding ring shape is performed during braiding, respectively.

It is indeed known from DE 10 2011 006 647 A1 for variable opening widths having a closed border to be implemented during braiding. Individual segments that are mounted so as to be unilaterally rotatable to each are provided with a dedicated drive by way of linear guides. However, here too, all segments are simultaneously swiveled about the same angle. By contrast, the present invention differs therefrom in that each segment herein can be moved independently of the other segments.

These advantages can be achieved in a particularly simple manner by way of a further aspect of the invention, wherein the braiding ring is subdivided into six segments. The six segments are disposed in an alternating manner in two parallel planes. The six segments form the shape of a hexagon. In order for there not to be any gap between the individual segments, in each case two successive segments are disposed in different planes. Thus, three segments are disposed in a first plane, and the other three segments are disposed in a second plane that is parallel with the first plane.

Advantageously, the segments at the one end of the former are rotatably mounted, wherein the other free end overlaps the articulation point of the subsequent segment. On account thereof, it is ensured that no gap can be formed between the segments that can lead to damage to the braiding threads or to a fault in the braided product, respectively.

The segments can be embodied so as to be straight, or curved with identical or dissimilar curvature radii.

A further aspect of the invention is characterized in that each segment has a longitudinal groove in which the adjustment installation engages in a displaceable manner. This describes a space-saving construction of the fastening of each adjustment installation on the associated segment of the latter. The mass of the segments is moreover reduced on account of the longitudinal groove, such that a rapid and force-saving adjustment is possible.

In order for the adjustment installation to be able to be retained in the longitudinal groove without additional fastening devices, the longitudinal groove has an indented peripheral region such that the adjustment installation cannot be released upwardly from the longitudinal groove.

Two alternative adjustment installations are also described. It is expedient herein for, in each case, opposite segments of the adjustment installation to be disposed on one common effective line, independently of the construction mode of said segments.

The refinement of the invention wherein all adjustment installations are mounted on one common retention ring describes a simple device-related construction of the braiding ring arrangement according to the invention.

On account of a design embodiment wherein every second segment and the respective adjustment installation associated with said segment is fastened to the retention ring by way of a spacer sleeve, all segments can be disposed on one side of the retention ring. Of course, it is also possible for one part of the segments to be disposed on the one side, and for the other part of the segments to be disposed on the rear side of the retention ring.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
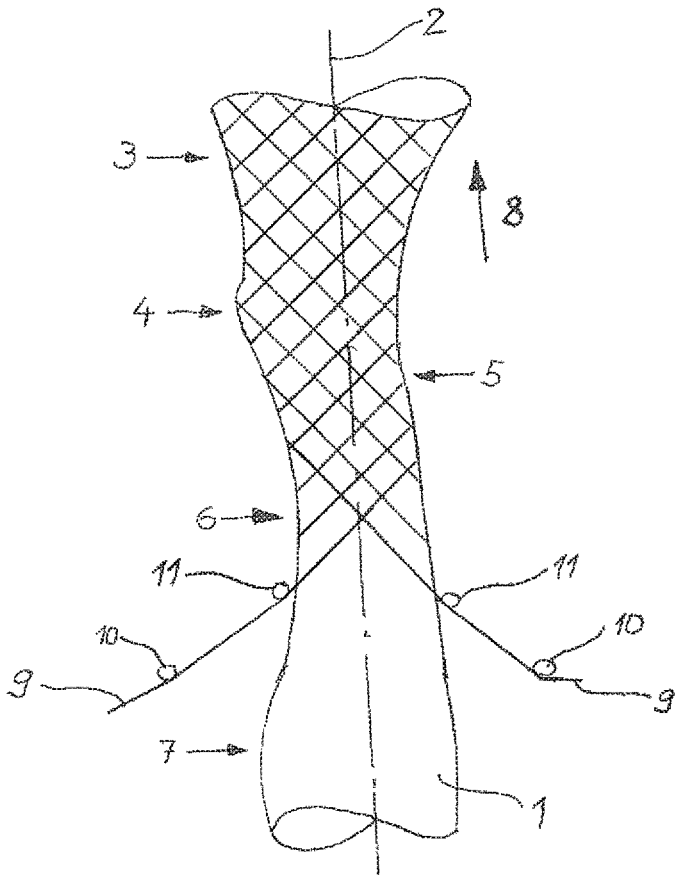
FIG. 1 is a schematic side view of a braiding core having braiding threads running onto the latter.

A side view of a part of a braiding core 1 is illustrated in FIG. 1.

The braiding core 1 has a longitudinal axis 2 and changing cross-section faces which are not always disposed symmetrically to the longitudinal axis 2 of the braiding core 1. The braiding core 1 in the circumferential region 3 thus has a symmetric encircling cross-sectional enlargement, while the braiding core 1 in the circumferential region 4 has a unilateral convexity and in the circumferential region 5 has a unilateral concavity. This, in the circumferential region 6, is adjoined by a symmetric constriction which then is symmetrically enlarged toward the circumferential region 7.

The transitions between the individual regions in the example illustrated are continuous but can also be abrupt or stepped.

The transportation direction of the braiding core 1 is identified by 8.

Typically, a multiplicity of braiding threads or braiding fibers 9, and possibly also additional filler threads or 0° threads (not shown) run onto the braiding core 1. For the purpose of visualization, only two braiding threads or braiding fibers 9 are illustrated in this example. The braiding threads or braiding fibers 9 are drawn from braiding thread spools (not illustrated in more detail). The braiding threads or braiding fibers 9 in this example are deflected by the internal circumference of a first braiding ring 10. This braiding ring 10 has a constant invariable diameter which is larger than the largest diameter of the braiding core 1.

This first braiding ring 10 can also be dispensed with, depending on the arrangement of the braiding thread spools.

A braiding ring 11 is disposed close to the run-on point on the braiding core 1. The braiding ring 11 deflects the braiding threads 9 in a manner tangential to the surface of the braiding core 1.

In order for a braided result of high quality to be obtained, or in order for the braided structure to be influenced in a localized targeted manner, the braiding ring 11 is located so as to be in the direct proximity of the surface of the braiding core 1. By virtue of the changing cross-sectional face of the braiding core 1, the braiding ring 11 in terms of the diameter thereof has to be adjustable.

Figure 2:
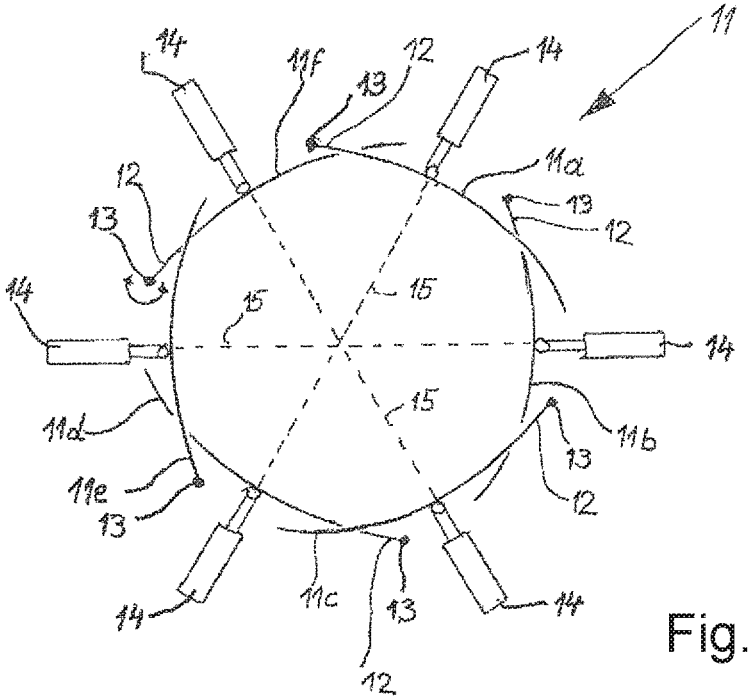
FIG. 2 is a schematic plan view of the braiding ring according to an embodiment of the invention, in a first position.

FIG. 2 schematically shows the braiding ring 11 according to the invention in terms of the construction thereof in a front view. The braiding ring 11 is composed of six segments 11*a* to 11*f* which form the sides of a hexagon. Each segment 11*a* to 11*f* has a constant or a changing curvature radius. Straight segments can also be used instead of curved segments 11*a* to 11*f*.

Each segment 11*a* to 11*f* at one end 12 is mounted so as to be rotatable about an articulation point 13. In order for the individual segments 11*a* to 11*f* in the plan view to be able to form an opening having a closed internal border, the segments are in each case disposed in an alternating manner in two parallel planes, as is yet to be shown further below. The end of each segment overlaps the beginning of the subsequent segment. In other words, the segment 11*a* lies in the front plane and terminates behind the articulation point 13 of the segment 11*b*; the segment 11*b* lies in the rear plane and terminates after the articulation point 13 of the segment 11*c* which in turn lies in the front plane.

Each segment 11*a* to 11*c* is pivoted by a dedicated adjustment installation 14 which is separately actuatable. Each adjustment installation 14 is preferably composed of an electro-mechanical, or else a pneumatic or hydraulic spindle drive which can be actuated by a dedicated suitable control installation. The free end of the spindle engages on the associated segment, as is yet to be shown further below.

The adjustment installations 14 of opposite segments lie on one common axis 15.

Figure 3:
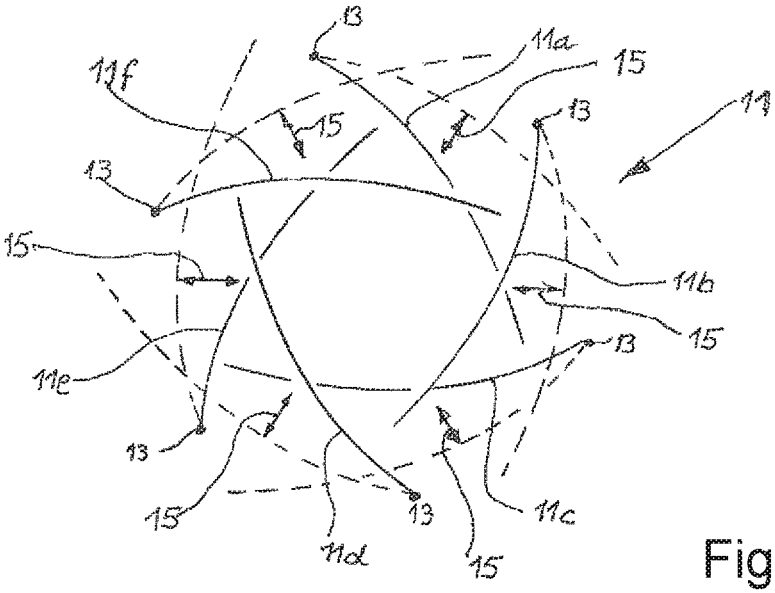
FIG. 3 is a schematic plan view of the braiding ring in a second position.

While all segments 11 in FIG. 2 are positioned such that the segments 11 form the largest possible diameter which a braiding core 1 that is to be braided using this arrangement can have, the segments 11 in FIG. 3 are shown in an inwardly pivoted position. It is evident here that the segments 11 delimit a substantially smaller diameter.

While FIG. 3 shows pivoting of all segments 11*a* to 11*f* in an identical manner, almost any arbitrary cross-sectional shape, in particular for complex braiding core geometries, can nevertheless be generated by way of the adjustment installation 14 which is actuatable separately for each segment.

Figure 4A:
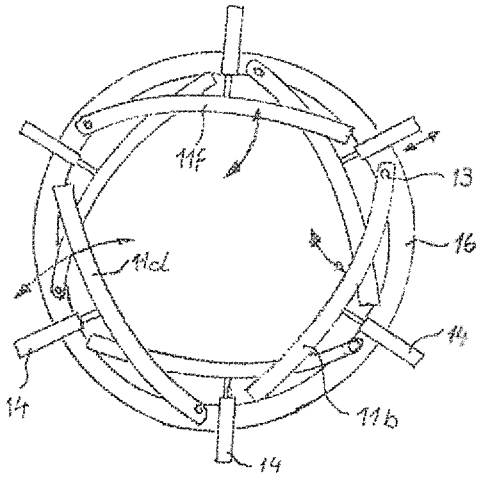
FIG. 4A is a plan view of an exemplary embodiment of the braiding ring according to the invention.
Figure 4B:
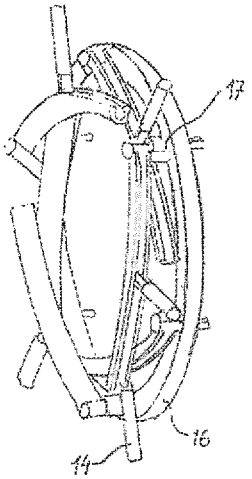
FIG. 4B is a perspective view of the braiding ring according to FIG. 4A.

A preferred technical implementation of the braiding ring 11 according to the invention is shown in FIGS. 4A and 4B. The individual segments 11*a* to 11*f* having their adjustment installations 14 are fastened to one common retention ring 16. In order for the two required planes to be represented, each second segment 11*b*, 11*d*, 11*f* is fastened to the retention ring 16 by way of spacer sleeves 17, as can be clearly seen in FIG. 4B. A second retention ring, spaced apart, or an alternating fastening on the front and rear side of the retention ring 16 is also possible instead of using the spacer sleeves 17.

Figure 5:
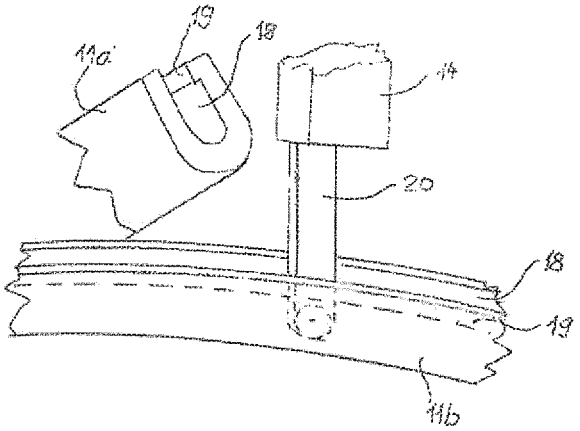
FIG. 5 is a perspective view of a part of a segment, having a longitudinal groove.

The articulation point of the spindle 20 of the adjustment installation 14 on a segment 11 is illustrated in FIG. 5. To this end, each segment 11*a* to 11*f* has one longitudinal groove 18 which is constricted at the upper periphery 19 thereof. The free end of the spindle 20 is disposed so as to be displaceable in this longitudinal groove 18 by way of a low-friction guide that, in terms of the cross section, is adapted to the longitudinal groove 18. It is ensured by this constriction 19 that the spindle 20 when returning cannot come out of the longitudinal groove 18. Alternatively, the segments 11 on that side that is opposite the guiding periphery of the former can also be mechanically connected to the associated adjustment installation 14 in another way.

LIST OF REFERENCE SIGNS

1 Braiding core
2 Longitudinal axis of 1
3 to 7 Circumferential regions of 1
8 Transportation direction of 1
9 Braiding thread
10 Braiding ring
11 Braiding ring
11*a* to 11*f* Segments of 11
12 End
13 Articulation point
14 Adjustment installation
15 Axis
16 Retention ring
17 Spacer sleeve
18 Longitudinal groove
19 Peripheral region
20 Spindle The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A braiding machine for braiding a braiding core, the braiding machine being configured to feed braiding threads in a continuous manner, the braiding machine comprising:
- a braiding machine cross section configured to vary in a longitudinal direction of the braiding core;
- at least two braiding thread spools;
- a braiding ring disposed between the at least two braiding thread spools and a run-on point of braiding threads onto the braiding core, the braiding threads being guided over an internal surface of the braiding ring, wherein
- the braiding ring comprises a plurality of adjustable segments, each adjustable segment of the braiding ring having a dedicated adjustment installation,
- each adjustment installation is actuatable independently of the adjustment installations of the other segments, and
- the plurality of adjustable segments are disposed, in an alternating manner, in two parallel planes.

2. The braiding machine according to claim 1, wherein the braiding machine is a circular braiding machine.

3. The braiding machine according to claim 1, wherein the braiding ring is subdivided into six segments.

4. The braiding machine according to claim 1, wherein
- each of the plurality of adjustable segments is rotatably mounted at one end thereof, and
- the other free end overlaps with a subsequent segment.

5. The braiding machine according to claim 2, wherein
- each of the plurality of adjustable segments is rotatably mounted at one end thereof, and
- the other free end overlaps with a subsequent segment.

6. The braiding machine according to claim 1, wherein the plurality of adjustable segments are curved.

7. The braiding machine according to claim 3, wherein the plurality of adjustable segments are curved.

8. The braiding machine according to claim 1, wherein
- each segment has a longitudinal groove in which an associated adjustment installation engages in a displaceable manner.

9. The braiding machine according to claim 8, wherein the longitudinal groove comprises an upper constricted peripheral region.

10. The braiding machine according to claim 8, wherein
- each adjustment installation comprises a cylinder-and-piston unit, wherein a free end of a piston rod slides in the longitudinal groove of the associated segment.

11. The braiding machine according to claim 1, wherein
- each adjustment installation comprises a cylinder-and-piston unit, wherein a free end of a piston rod slides in a longitudinal groove of a respective one of the plurality of adjustable segments.

12. The braiding machine according to claim 8, wherein each adjustment installation comprises an electro-mechanical spindle drive, wherein a free end of a spindle slides in the longitudinal groove of the associated segment.

13. The braiding machine according to claim 1, wherein each adjustment installation comprises an electro-mechanical spindle drive, wherein a free end of a spindle slides in a longitudinal groove of a respective one of the plurality of adjustable segments.

14. The braiding machine according to claim 10, wherein all adjustment installations are mounted on one common retention ring.

15. The braiding machine according to claim 12, wherein all adjustment installations are mounted on one common retention ring.

16. The braiding machine according to claim 1, wherein all adjustment installations are mounted on one common retention ring.

17. The braiding machine according to claim 14, wherein every second segment of the plurality of segments and the respective associated adjustment installation is fastened to the retention ring via a spacer sleeve.

* * * * *